US011791109B2

(12) United States Patent
Skuci et al.

(10) Patent No.: US 11,791,109 B2
(45) Date of Patent: Oct. 17, 2023

(54) THREE-POSITION DISCONNECTOR SWITCH

(71) Applicant: ABB Schweiz AG, Baden (CH)

(72) Inventors: Michal Skuci, Brno (CZ); Josef Cernohous, Jamne nad Orlici (CZ); Radek Javora, Hrusovany u Brna (CZ); Tomas Kozel, Brno (CZ)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/741,569

(22) Filed: May 11, 2022

(65) Prior Publication Data

US 2022/0367127 A1 Nov. 17, 2022

(30) Foreign Application Priority Data

May 14, 2021 (EP) ..... 21173953

(51) Int. Cl.

| | |
|---|---|
| ***H01H 1/06*** | (2006.01) |
| ***H01H 1/20*** | (2006.01) |
| ***H01H 1/36*** | (2006.01) |
| ***H01H 1/62*** | (2006.01) |

(52) U.S. Cl.

CPC ..... *H01H 1/365* (2013.01); *H01H 1/06* (2013.01); *H01H 1/20* (2013.01); *H01H 1/62* (2013.01)

(58) Field of Classification Search

CPC ..... H01H 1/365; H01H 1/06; H01H 1/20; H01H 1/62; H01H 1/36; H01H 31/32; H01H 31/02; H01H 31/26; H01H 31/04; H01H 31/08

USPC ..... 200/502, 571, 572, 243, 252, 253.1; 218/55, 67, 79, 80, 93, 100, 107

See application file for complete search history.

(56) References Cited

U.S. PATENT DOCUMENTS

| | | | | |
|---|---|---|---|---|
| 3,740,508 A * | 6/1973 | Olsen | H01H 33/56 | 218/67 |
| 4,255,632 A * | 3/1981 | Backskog | H02B 13/075 | 218/55 |
| 6,946,613 B2 * | 9/2005 | Otsuka | H01H 31/32 | 218/78 |

(Continued)

FOREIGN PATENT DOCUMENTS

| | | |
|---|---|---|
| EP | 3671789 A1 | 6/2020 |
| EP | 3754681 A1 | 12/2020 |

OTHER PUBLICATIONS

European Patent Office, Extended European Search Report in European Application No. 21173953.7, 7 pp. (dated Nov. 8, 2021).

*Primary Examiner* — William A Bolton

(74) *Attorney, Agent, or Firm* — Leydig, Voit & Mayer, Ltd.

(57) ABSTRACT

A three-position disconnector switch includes an earthing contact, a power out contact, a power in contact, and a piston. The power out contact comprises first and second parts connected by a leg portion. In a first position, the piston contacts the first part of the power out contact. In a second position, the piston contacts the first part of the power out contact and makes electrical contact with the second part. In a third position, the piston contacts the second part and makes electrical contact with the earthing contact. The piston is configured to move along an axis of the three-position disconnector switch to transition the three-position disconnector switch between the different switch positions.

17 Claims, 3 Drawing Sheets

(56) References Cited

U.S. PATENT DOCUMENTS

| | | | | |
|---|---|---|---|---|
| 8,729,985 | B2 * | 5/2014 | Bullock | H01H 33/6662 335/120 |
| 9,343,881 | B2 * | 5/2016 | Hyrenbach | H02B 13/045 |
| 11,342,140 | B2 * | 5/2022 | Gentsch | H01H 31/32 |
| 2012/0012449 | A1 * | 1/2012 | Shin | H01H 33/42 200/5 B |
| 2013/0248338 | A1 * | 9/2013 | Belloni | H01H 9/02 200/5 A |
| 2020/0203936 | A1 * | 6/2020 | Kozel | H02B 13/0352 |

* cited by examiner

THREE-POSITION DISCONNECTOR SWITCH

CROSS-REFERENCE TO RELATED APPLICATIONS

This patent application claims priority to European Patent Application No. 21173953.7, filed on May 14, 2021, which is incorporated herein in its entirety by reference.

FIELD OF THE DISCLOSURE

The present disclosure relates to a three-position disconnector switch and a switchgear or control gear for low voltage, medium voltage or high voltage for use with a sub station.

BACKGROUND OF THE INVENTION

Known three-position disconnector switches in use today require to have a certain length, in order to guarantee proper mechanical functionality as well as to keep necessary dielectric distances between parts of the switch and surroundings during testing and operation.

Usage of such a disconnector, for example in an air insulated medium voltage switchgear, requires that there are three switch positions, each with full dielectric performance. Any design of a disconnector must respect sufficient dielectric distances to achieve a middle position that is fully insulated. These distances are repeated three times with a linear variant of a disconnector, where a length of the disconnector is influenced twice by the air gap and also by a length of a movable contact which must be long enough to make contact between contacts within the constraints of also having extended air gaps.

The simplest and usual way to make a linear three-position disconnector is with three separate single contacts and a piston connecting them. In the situation where there is a need to increase the dielectric insulation level, both air gaps between the movable contact and the side fixed contacts have to be increased. Then to reach the correct positions, a length of piston also has to be extended or increased. Thus there is a three-fold increase in length that affects the overall length of three-position disconnector switch, and thus leads to a cost of the complete switch assembly increasing, as well as bringing a disadvantage of an increased total size.

BRIEF SUMMARY OF THE INVENTION

Based on the foregoing, it would be advantageous to have an improved three-position disconnector switch.

The object of the present invention is solved with the subject matter of the independent claims, wherein further embodiments are incorporated in the dependent claims. In a first aspect, there is provided a three-position disconnector switch, comprising an earthing contact, a power out contact, a power in contact, and a piston.

The power out contact comprises a first part and a second part, and the first part is connected to the second part by a leg portion. In a first switch position, an outer surface of a wall of the piston makes a direct electrical contact with the first part of the power out contact and makes a direct electrical contact with the power in contact. In a second switch position, the outer surface of the wall of the piston makes a direct electrical contact with the first part of the power out contact and makes a direct electrical contact with the second part of the power out contact. In a third switch position, the outer surface of wall of the piston makes a direct electrical contact with the second part of the power out contact and makes a direct electrical contact with the earthing contact. The piston is configured to move along an axis of the three-position disconnector switch to transition the three-position disconnector switch between the different switch positions.

BRIEF DESCRIPTION OF THE SEVERAL VIEWS OF THE DRAWING(S)

Exemplary embodiments will be described in the following with reference to the following drawings.

FIGS. 1A, 1B, and 1C show schematic representations of a new three-position disconnector (100) in accordance with the disclosure, and of an existing switch (101) for comparison, in three operating positions.

DETAILED DESCRIPTION OF THE INVENTION

FIGS. 1A-1C, 2, and 3A-3B relate to a new three-position disconnector switch 100. The new switch 100 is shown adjacent an existing switch 101 in various operating positions for comparison. For example, the new switch 100 and existing switch 101 are shown in a first position in FIG. 1A, in a second position in FIG. 1B, and in a third position in FIG. 1C.

Figure 2:
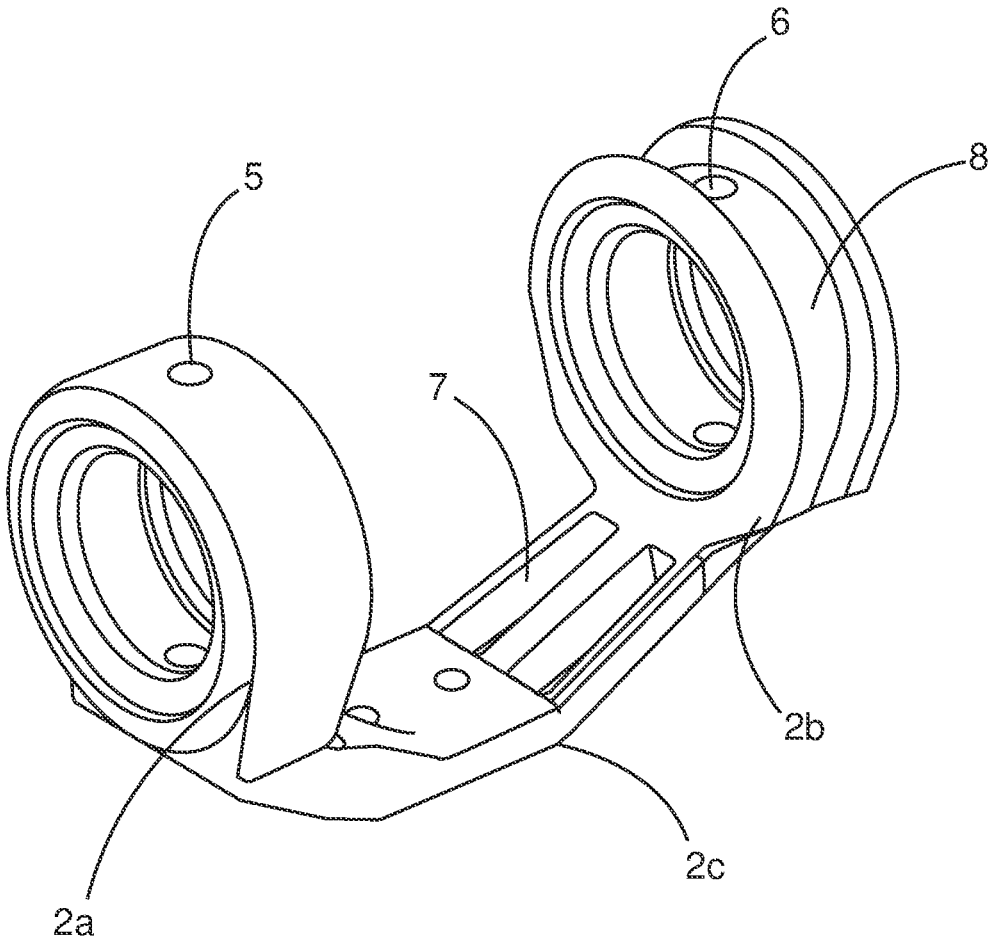
FIG. 2 shows a middle or power out contact of the new three-position disconnector switch (100) as shown in FIGS. 1A, 1B, and 1C.
Figure 3A:
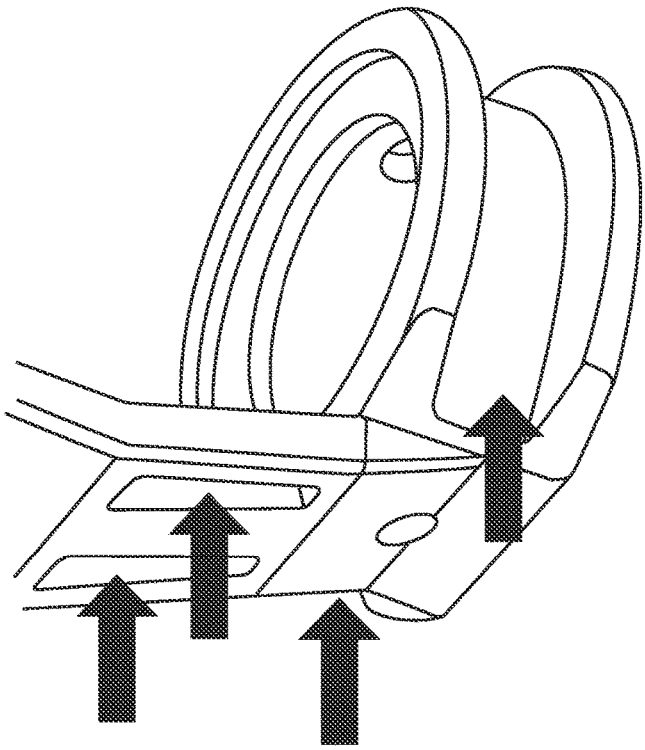
FIGS. 3A and 3B show a second end portion and part of a leg portion of the middle or power out contact, from two perspectives, of the new three-position disconnector switch in accordance with the disclosure.
Figure 3B:
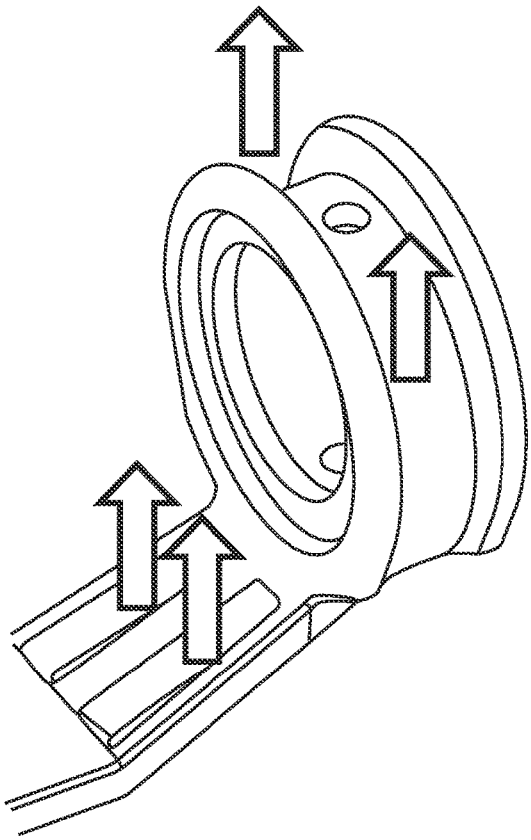

In an example, the new three-position disconnector switch 100 comprises an earthing contact 1, a power out contact 2, a power in contact 3, and a piston 4. The power out contact comprises a first part 2*a* and a second part 2*b*, as shown in FIG. 2. The first part 2*a* is connected to the second part 2*b* by a leg portion 2*c*. In a first switch position, an outer surface of a wall of the piston makes a direct electrical contact with the first part of the power out contact and makes a direct electrical contact with the power in contact. In a second switch position, the outer surface of the wall of the piston makes a direct electrical contact with the first part of the power out contact and makes a direct electrical contact with the second part of the power out contact. In a third switch position, the outer surface of wall of the piston makes a direct electrical contact with the second part of the power out contact and makes a direct electrical contact with the earthing contact. The piston is configured to move along an axis of the three-position disconnector switch to transition the three-position disconnector switch between the different switch positions.

In an example, in the first switch position, the outer surface of the wall of the piston does not makes a direct electrical contact with the second part of the power out contact.

In an example, in the third switch position, the outer surface of the wall of the piston does not makes a direct electrical contact with the first part of the power out contact.

In an example, an outer extent of the first part of the power out contact faces the power in contact and an outer extent of the second part of the power out contact faces the earthing contact. A length of the piston in the direction of the axis of the three-position disconnector switch is less than, or equal to, a distance between the outer extent of the first part of the power out contact and the outer extent of the second part of the power out contact.

In an example, a mass of material of the first part of the power out contact is greater than a mass of material of the second part of the power out contact.

In an example, the first part of the power out contact comprises an annular portion centered around the axis of the three-position disconnector switch.

In an example, the annular portion comprises at least one cooling hole 5 extending through a wall of the annular portion.

In an example, the second part of the power out contact comprises an annular portion centered around the axis of the three-position disconnector switch.

In an example, the annular portion comprises at least one cooling hole 6 extending through a wall of the annular portion.

In an example, the annular portion comprises an open cooling channel 8 in the wall of the annular portion, and wherein the open cooling channel is centered around the axis of the three-position disconnector switch.

In an example, the leg portion of the power out contact comprises at least one cooling hole 7.

In an example, the at least one cooling hole of the leg portion of the power out contact is located within a part of the leg portion of the power out contact between a mounting region of the leg portion of the power out contact and the second part of the power out contact.

From the above, it is clear that the new three-position disconnector switch can be utilized in a low voltage, medium voltage or high voltage switchgear or control gear, and where there can be for example three such disconnectors, one for each phase of a three phase system.

It is contemplated that a way to shorten traditional linear three-position disconnector switches is to change a single middle contact (power out contact) to double middle contact (power out contact).

Continuing with the new three-position disconnector switch shown in the figures, the new design is to change a single middle contact, here the power out contact, to double middle contact, or power out contact 2. This configuration allows to have longer air gaps in the same overall dimensions of the disconnector therefore to reach higher dielectric limits without suffering on cost and size of the solution.

Figure 1A:
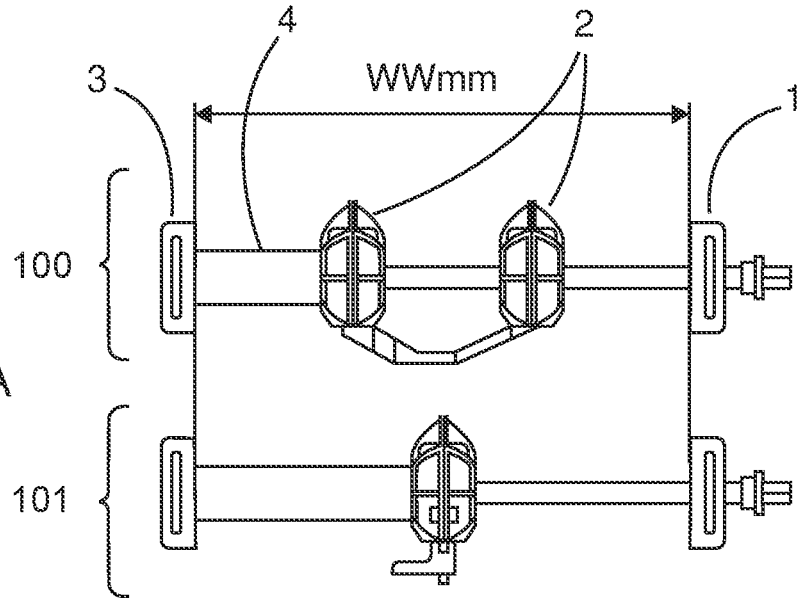
Figure 1B:
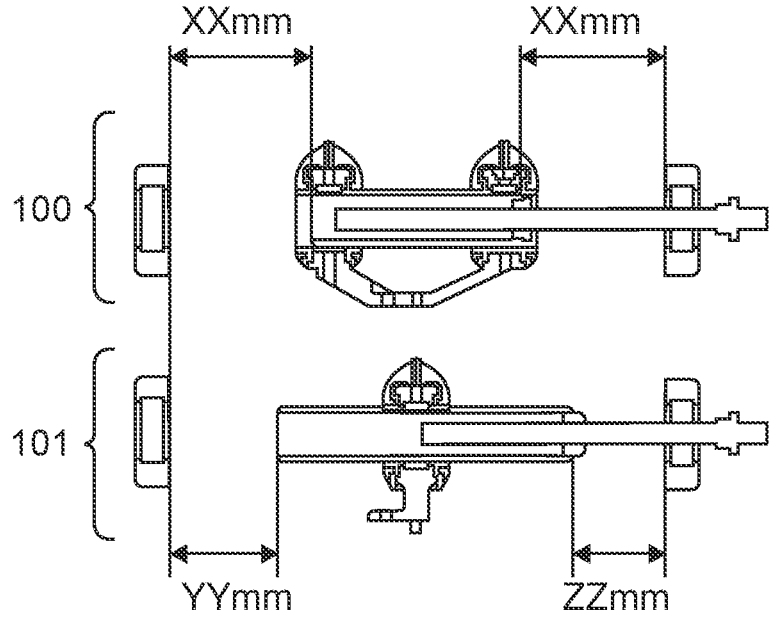
Figure 1C:
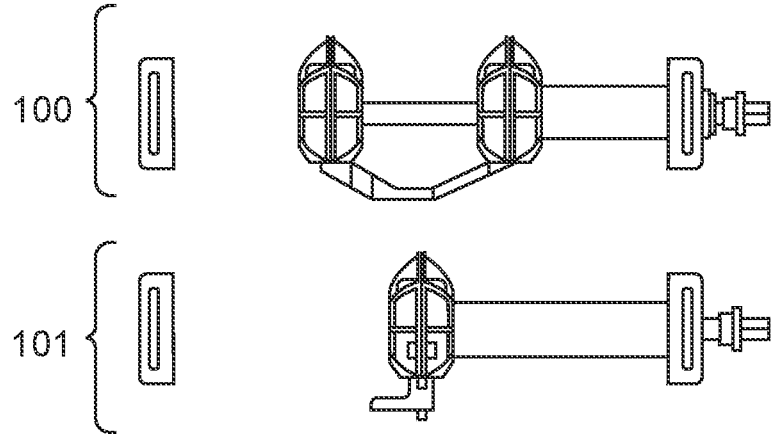

FIG. 1A shows a new three-position disconnector switch 100 and an existing three-position disconnector switch 101 in a first position. The switches 100 and 101 are shown in a second operating position in FIG. 1B, and in a third operating position in FIG. 1C. The new three-position disconnector switch 100 has a fork type double middle or power out contact 2. Shown at the left, in a first switch position (FIG. 1A), the piston 4 contacts the power in contact and a first part 2*a* of the middle or power out contact 2. Shown in the middle, in a second switch position (FIG. 1B), the piston contacts both the first part 2*a* and a second part 2*b* of the middle or power out contact 2. In a third switch position (FIG. 1C), the piston 4 contacts the right hand side or second part 2*b* of the middle or power out contact and contacts an earthing contact 1.

As shown in the comparison between the new three-position disconnector switch 100 and the existing three-position disconnector switch 101, for the same overall length WW, increased dielectric insulating performance is provided, where distance XX is greater than distance YY and distance ZZ in the existing three-position disconnector switch. Exemplar distances are WW=460 mm, XX=132.5 mm, YY=100 mm and ZZ=85 mm.

Another advantage of the new design with a fork type middle or power out contact 2 is that in the middle position, from a dielectric point of view, the piston 4 can "hide" inside the middle or power out contact. This shape of the middle contact can provide for enhanced dielectric protection.

As shown in FIG. 2, the fork type middle or power out contact 2 also leads to cooling and cost benefits. In addition to its naturally greater surface for convection and radiation from having two parts, when the three-position disconnector switch is in a first switch position where the piston connects the power in contact 3 to the middle or power out contact 2, the piston 4 only connects to a first part 2*a* of the power out connector (see FIG. 1A). The power out connector 2 has a leg portion 2*c* that connects the first part 2*a* to the second part 2*b*. As shown in FIG. 2, the leg portion 2*c* has mounting holes in a flat portion that connects to the power out line. Thus, in the connected position the current flows through first part 2*a* of the contact and part of the leg portion only and does not flow through the second part 2*b*. Therefore, the second part 2*b* of the contact 2 can be light-weight due to its requirement to carry a short-circuit current for a short period of time only. This results in a lower production cost than for a contact 2 that has equally robust halves. Also, the contact can have free space directly between side contacts themselves. Side contacts are materially connected with middle contact area in a shortest and cost-effective way.

There can be also be cooling holes/channel/gaps in the second part 2*b* of the contact 2 to act as a cooler to further increase system performance when normally operated. The shape is demonstrated at FIGS. 3A and 3B, from two perspectives, where cold air is shown using solid arrows at the left (FIG. 3A) that is heated up and is flows around and through cooling holes/channel 6, 7 and 8 and is heated up and flows away from the part shown by white arrows at the right (FIG. 3B) and therefore provides for cooling. Thus, as shown, there are cooling air gaps 7 in the leg 2*c* of the second part of the power out contact 2 that has a ring or annular shape and there can also be a channel 8 around the ring for additional ventilation. Also, as shown cooling holes 5 and 6 can be provided in the annular or ring shapes of the first part 2*a* and second part of the power out contact, to allow air to flow through and provide cooling.

In an example, in the first switch position the outer surface of the wall of the piston does not makes a direct electrical contact with the second part of the power out contact.

In an example, in the third switch position the outer surface of the wall of the piston does not makes a direct electrical contact with the first part of the power out contact.

In an example, an outer extent of the first part of the power out contact faces the power in contact and an outer extent of the second part of the power out contact faces the earthing contact. A length of the piston in the direction of the axis of the three-position disconnector switch is less than, or equal to, a distance between the outer extent of the first part of the power out contact and the outer extent of the second part of the power out contact.

In an example, a mass of material of the first part of the power out contact is greater than a mass of material of the second part of the power out contact.

In an example, the first part of the power out contact comprises an annular portion centred around the axis of the three-position disconnector switch.

In an example, the annular portion comprises at least one cooling hole extending through a wall of the annular portion.

In an example, the second part of the power out contact comprises an annular portion centred around the axis of the three-position disconnector switch.

In an example, the annular portion comprises at least one cooling hole extending through a wall of the annular portion.

In an example, the annular portion comprises an open cooling channel in the wall of the annular portion, and wherein the open cooling channel is centred around the axis of the three-position disconnector switch.

In an example, the leg portion of the power out contact comprises at least one cooling hole.

In an example, the at least one cooling hole of the leg portion of the power out contact is located within a part of the leg portion of the power out contact between a mounting region of the leg portion of the power out contact and the second part of the power out contact.

In a second aspect, there is provided a low voltage, medium voltage or high voltage switchgear or control gear comprising one or more three-position disconnector switches according to the first aspect.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A three-position disconnector switch, comprising:

an earthing contact;

a power out contact;

a power in contact; and a piston;

wherein the power out contact comprises a first part, a second part, and a leg portion interconnecting the first part and the second part, the leg portion having a width that extends only partially about a periphery of each of the first part and the second part;

wherein, in a first switch position, an outer surface of a wall of the piston makes a direct electrical contact with the first part of the power out contact and makes a direct electrical contact with the power in contact;

wherein, in a second switch position, the outer surface of the wall of the piston makes a direct electrical contact with the first part of the power out contact and makes a direct electrical contact with the second part of the power out contact;

wherein, in a third switch position, the outer surface of wall of the piston makes a direct electrical contact with the second part of the power out contact and makes a direct electrical contact with the earthing contact; and wherein the piston is configured to move along an axis of the three-position disconnector switch to transition the three-position disconnector switch between the different switch positions.

2. The three-position disconnector switch according to claim 1, wherein, in the first switch position, the outer surface of the wall of the piston does not makes a direct electrical contact with the second part of the power out contact.

3. The three-position disconnector switch according to claim 1, wherein, in the third switch position, the outer surface of the wall of the piston does not makes a direct electrical contact with the first part of the power out contact.

4. The three-position disconnector switch according to claim 1, wherein an outer extent of the first part of the power out contact faces the power in contact and an outer extent of the second part of the power out contact faces the earthing contact, and wherein a length of the piston in a direction of the axis of the three-position disconnector switch is less than or equal to a distance between the outer extent of the first part of the power out contact and the outer extent of the second part of the power out contact.

5. The three-position disconnector switch according to claim 1, wherein a mass of material of the first part of the power out contact is greater than a mass of material of the second part of the power out contact.

6. The three-position disconnector switch according to claim 1, wherein the first part of the power out contact comprises an annular portion centered around the axis of the three-position disconnector switch.

7. The three-position disconnector switch according to claim 6, wherein the annular portion comprises at least one cooling hole extending through a wall of the annular portion.

8. The three-position disconnector switch according to claim 1, wherein the second part of the power out contact comprises an annular portion centered around the axis of the three-position disconnector switch.

9. The three-position disconnector switch according to claim 8, wherein the annular portion comprises at least one cooling hole extending through a wall of the annular portion.

10. The three-position disconnector switch according to claim 8, wherein the annular portion comprises an open cooling channel in the wall of the annular portion, and wherein the open cooling channel is centered around the axis of the three-position disconnector switch.

11. The three-position disconnector switch according to claim 10, wherein the at least one cooling hole of the leg portion of the power out contact is located within a part of the leg portion of the power out contact between a mounting region of the leg portion of the power out contact and the second part of the power out contact.

12. The three-position disconnector switch according to claim 1, wherein the leg portion of the power out contact comprises at least one cooling hole.

13. The three-position disconnector switch according to claim 1, wherein the leg portion at least partially extends radially away from the axis.

14. The three-position disconnector switch according to claim 1, wherein the leg portion extends diagonally from the first part relative to the axis, and wherein the leg portion extends diagonally from the second part relative to the axis.

15. The three-position disconnector switch according to claim 1, wherein at least part of the leg portion is arranged radially further from the axis than a radially outermost surface of each of the first part and the second part.

16. The three-position disconnector switch according to claim 1, wherein the power out contact has a fork-like configuration with the first part and the second part each forming prongs of the fork.

17. A three-position disconnector switch, comprising:

an earthing contact;

a power out contact;

a power in contact; and a piston;

wherein the power out contact comprises a first part, a second part, and a leg portion interconnected between-the first part and the second part;

wherein, in a first switch position, an outer surface of a wall of the piston makes a direct electrical contact with the first part of the power out contact and makes a direct electrical contact with the power in contact;

wherein, in a second switch position, the outer surface of the wall of the piston makes a direct electrical contact with the first part of the power out contact and makes a direct electrical contact with the second part of the power out contact;

wherein, in a third switch position, the outer surface of wall of the piston makes a direct electrical contact with the second part of the power out contact and makes a direct electrical contact with the earthing contact;

wherein the piston is configured to move along an axis of the three-position disconnector switch to transition the three-position disconnector switch between the different switch positions; and wherein a mass of material of the first part of the power out contact is greater than a mass of material of the second part of the power out contact.

* * * * *